United States Patent [19]

Naitou

[11] Patent Number: 4,931,807

[45] Date of Patent: Jun. 5, 1990

[54] NON-STATIONARY ANTENNA WITH SLEEVE AND RESONANT CIRCUIT

[75] Inventor: Katsumi Naitou, Yawatahama, Japan

[73] Assignee: Nippon Tsushin Densen Company Ltd., Yawatahama, Japan

[21] Appl. No.: 366,519

[22] Filed: Jun. 15, 1989

[30] Foreign Application Priority Data

Mar. 28, 1989 [JP] Japan ..... 64-76164

[51] Int. Cl.[5] ..... H01Q 9/04

[52] U.S. Cl. ..... 343/745; 343/791

[58] Field of Search ..... 343/722, 749, 750, 792, 343/790, 791, 745, 900

[56] References Cited

U.S. PATENT DOCUMENTS 3,438,042 4/1969 Kuecken ..... 343/792

FOREIGN PATENT DOCUMENTS 1263027 2/1972 United Kingdom ..... 343/750

*Primary Examiner*—Rolf Hille
*Assistant Examiner*—Michael C. Wimer
*Attorney, Agent, or Firm*—Cushman, Darby & Cushman

[57] ABSTRACT

Disclosed is a non-stationary antenna whose characteristics are guaranteed free of the surrounding variables, such as configuration of the land, electrically conductive condition of the earth's surface, buildings of different heights or climatic changes. The non-stationary antenna has upper and lower antenna conductors decoupled by the capacitors of a resonator arrangement. Thus, if the surrounding variables should cause an adverse effect on the upper antenna conductor, it cannot be transmitted to the lower antenna conductor. Also, the antenna can be bent, and can be held in the bending position until it is straightend with hands. Thus, no matter what posture an associated wireless may take, the antenna can be bent so as to take a vertical posture, which is most appropriate for radiating or receiving electromagnetic waves.

3 Claims, 4 Drawing Sheets

NON-STATIONARY ANTENNA WITH SLEEVE AND RESONANT CIRCUIT

BACKGROUND OF THE INVENTION:

1. Field of the Invention

The present invention relates to a non-stationary or mobile antenna, and particularly to a non-stationary antenna which is designed to permit: the setting of the antenna for a desired resonance condition in the course of manufacture; the setting of the antenna for a desired resonance condition to meet particular resonance requirements in different applications when in use and independence of antenna characteristics from the surrounding condition which may vary while the non-stationary antenna is being carried.

2. Description of the Prior Art

As is well known, non-stationary antennas have been widely used. For instance, a car radio is equipped with a non-stationary antenna, and a portable radio is equipped with a non-stationary antenna One example of such a non-stationary antenna is disclosed in Japanese Utility Model Publication 48-2029. It has a coil-and-capacitor resonance circuit connected to a central antenna conductor. In the course of manufacture the length of the central antenna conductor and the capacitance and inductance of the resonator circuit are fixedly adjusted according to prescriptions, thus providing a fixed characteristic impedance. The fixing of the characteristic impedance of an antenna, however, prevents wide application of the antenna. In an attempt to expand the range of application the antenna is designed to permit the trimming of selected resonant circuit elements to meet particular requirements. For this purpose the resonator circuit is designed to have a variable capacitor, thereby permitting adjustment of the characteristic impedance of the antenna to meet a particular frequency request in the course of manufacture.

No matter which type of resonator circuit may be used, coil-and-capacitor series connection or coil-and-capacitor parallel connection, the central antenna conductor cannot be separated by the resonator circuit, remaining in the form of a single continuous conductor line. Also, the conventional non-stationary antenna uses a single resonator circuit. In the conventional non-stationary antenna its central antenna conductor can be adjusted in length, but it cannot be bent.

Thus, the defects of the conventional non-stationary antenna are as follows:

1. While one is carrying a wireless equipped with an antenna or while a car equipped with an antenna is running, the characteristics of the antenna is apt to vary from place to pace. Particularly, natural elevation or depression of the earth's surface, electrically conductive ground condition of a particular place, buildings of different heights etc. will affect the reflection of the radiated electromagnetic wave from the ground to the antenna. Also, the strength of the magnetic field on the earth's surface on terrestrial magnetism somewhat varies from place to place, and accordingly the effect caused by the magnetic field on the earth's surface on the antenna will vary. These variables will cause an induction current to flow in the antenna, and the induction current will vary while the antenna is moving, causing the variation of the set resonant frequency, radiation impedance, voltage standing wave ratio, radiation angle and other characteristics of the antenna To assure that the antenna remains in stable condition, the antenna must be independent from such variable factors. However, it is difficult to keep the antenna free from such surrounding valiables because the central antenna conductor is connected directly to the resonator circuit, thereby permitting such variation to affect the antenna.
2. Sometimes, the antenna is carried in the rain snow. Sometimes, the antenna is put in contact with a metal object or human body. There is an occasion in which one must hold the antenna in one's hand. In these occasions the resonant frequency, frequency band width, radiation impedance, voltage standing wave ratio, radiation angle, gain and other characteristics of the antenna will vary. Such variation although not large in quantity, cannot be avoided so far as the central antenna conductor is connected to the resonator circuit.
3. The antenna uses a single parallel or series resonator circuit. The resonator circuit has variable element for the sake of trimming its resonating frequency in the course of manufacture, thereby permitting the antenna to fit to a particular use of application. The use of a single resonator circuit with a variable element, however, prevents selection and fine adjustment of the resonance frequency among a wide range of frequency or exact determination of resonance frequency required for a particular application.
4. The antenna is longitudinally extensible, but it cannot be bent. Particularly it cannot be bent and held in bending condition. When one carries the antenna on one's back, and when he lies on his front, the antenna is accordingly laid, thereby lowering the antenna's receiving capability.

SUMMARY OF THE INVENTION

In view of the above one object of the present invention is to provide a non-stationary antenna whose characteristics remain independent from surrounding conditions no matter how they may change, thus assuring the stable transmitting and receiving condition.

Another object of the present invention is to provide non-stationary antenna which permits fine adjustment and setting of resonance frequency in the course of manufacture to fit a particular use or application.

Still another object of the present invention is to provide a non-stationary antenna which permits the antenna to take the vertical posture no matter what posture an associated wireless may take. According to a first aspect of the present invention a non stationary antenna comprises a central antenna conductor composed of an upper antenna section and a lower antenna section: a cylindrical metal sleeve encircling said lower antenna section: a coil-and-capacitor resonator arrangement placed in said lower antenna section, a part of said lower antenna section being composed of the central conductor of a coaxial wire, the outer sheath conductor of said coaxial wire being made open at one end, and being connected at the other end to said cylindrical metal sleeve, said coil-and-capacitor resonator arrangement comprising a plurality of parallel-connected resonators, each comprising a coil-and-capacitor series connection, each series connection including a parallel connection of a non-variable capacitor and a variable capacitor, whereby the upper section of said central antenna conductor extending above said capacitors of said coil-and-capacitor resonator arrangement is not directly connected to the remaining lower section of said central antenna conductor.

When manufacturing, the upper and lower antenna sections and other linear elements are made to have predetermined lengths according to prescriptions, and the resonator unit is tuned to the exact resonance frequency for a particular use of application. The fine tunning can be easily performed because the coil-and-capacitor resonator unit has many variable elements. Necessary trimming can be carried out by adjusting selected variable elements one after another. Each variable element will cause a least effect on the adjustment of resonance frequency, thus permitting the fine adjustment of resonance frequency to the possible closest desired frequency. The parallel connection of a variable capacitor across an associated non-variable capacitor facilitates the fine-tunning of the resonator circuit. According to a second aspect of the present invention the non-variable capacitor of one of the parallel-connected resonators has a capacitance larger than the non-variable capacitor each of the remaining resonators, thereby facilitating the fine-tunning of the resonator arrangement. In the course of manufacture the resonator arrangement is adjusted, and fixed with molding material. The capacitors of the resonator arrangement decouple the central antenna conductor into upper and lower antenna sections. The upper antenna section is put in floating condition in the air. When the antenna is carried from place to place, an induction current will be inducted in the upper antenna section owing to the variation in reflection of electromagnetic wave from the ground or the variation in the strength of the magnetic field on the earth's surface, but the induction current cannot flow into the resonance circuit to cause the antenna to change its characteristics.

In addition, one end of the outer conductor sheath of a coaxial cable, which constitutes a part of the central antenna conductor in the lower antenna section, is not terminated, whereas the other end of the outer conductor sheath of the coaxial cable is connected to a cylindrical metal sleeve. Therefore, the outer sheath of the coaxial cable has an impedance high enough to prevent electric current to flow, causing no standing wave to appear, and radiating no electromagnetic wave This assists in stabilizing the characteristics of the antenna. According to a third aspect of the present invention the intermediate part of the upper antenna section comprises a metal spring coil and a metal spiral strip fitted in the turn spaces of the metal coil spring, thereby permitting the bending of the upper antenna section to take a vertical posture, which is most desirable for an antenna designed to receive vertical polarized plane wave, no matter what posture an associated wireless may take.

Other objects and advantages of the present invention will be understood from the following description of a non-stationary antenna according to a preferred embodiment of the present invention shown in the accompanying drawings:

DETAILED DESCRIPTION OF THE PREFERRED EMBODIMENT

Figure 1:
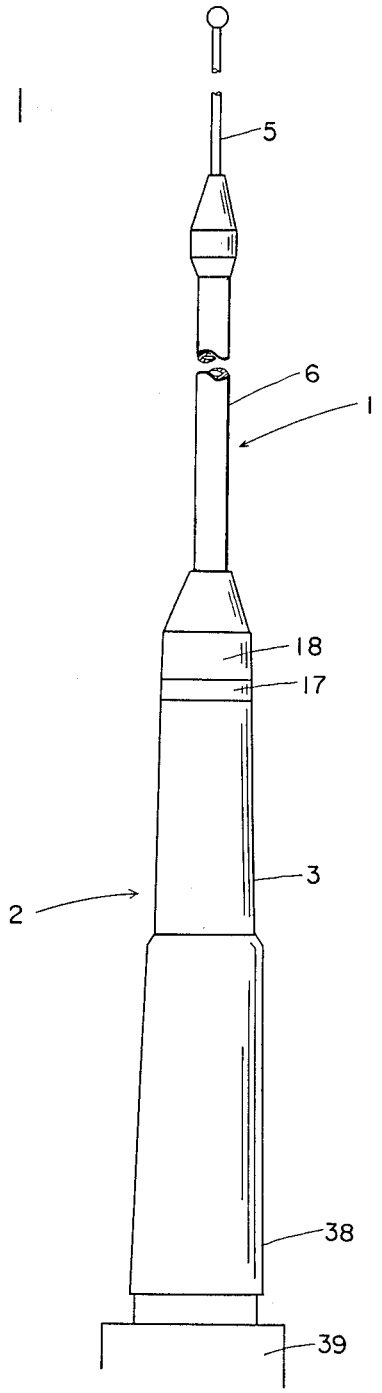
FIG. 1 is a side view of the non-stationary antenna.

Referring to the drawinGS, a non-stationary antenna according to the present invention comprises an upper antenna section 1 and a lower antenna section 2. The lower antenna section 2 has a coaxial cylindrical metal sleeve 3. These upper and lower antenna sections 1 and 2 constitute a central antenna conductor which is indicated at 4.

Figure 3:
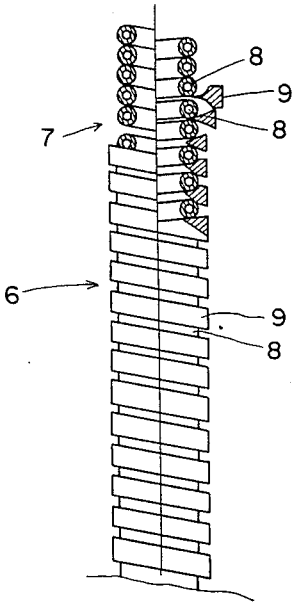
FIG. 3 is a longitudinal section of the intermediate part of the non-stationary antenna.

The upper antenna section 1 is composed of a whip part 5 and an intermediate part 6, which is composed of a metal coil spring 7 and a spiral metal strip g partly fitted into the spaces between adjacent turns of the coil spring 7, as shown in FIG. 3.

Figure 2:
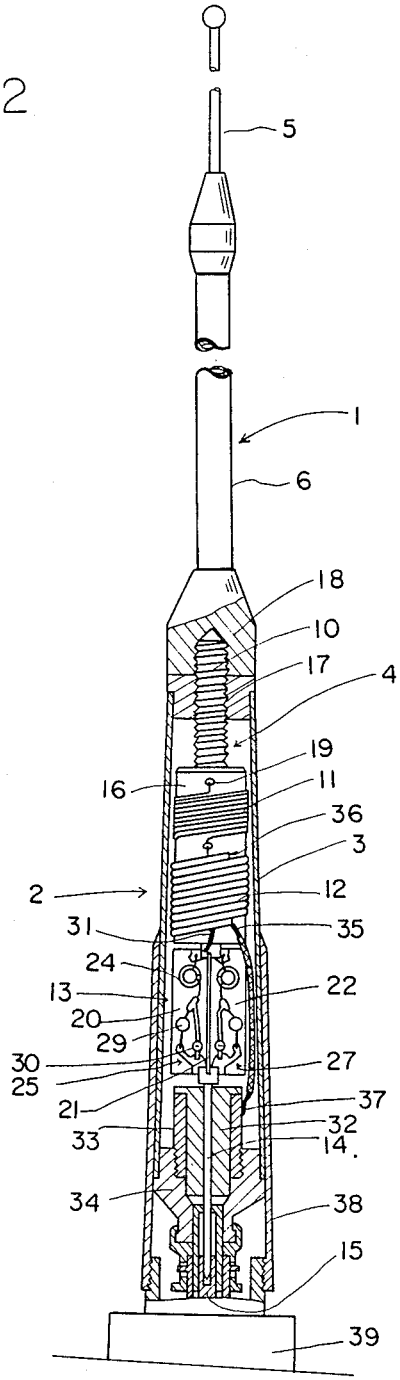
FIG. 2 is a longitudinal section of the non-stationary antenna.
Figure 5:
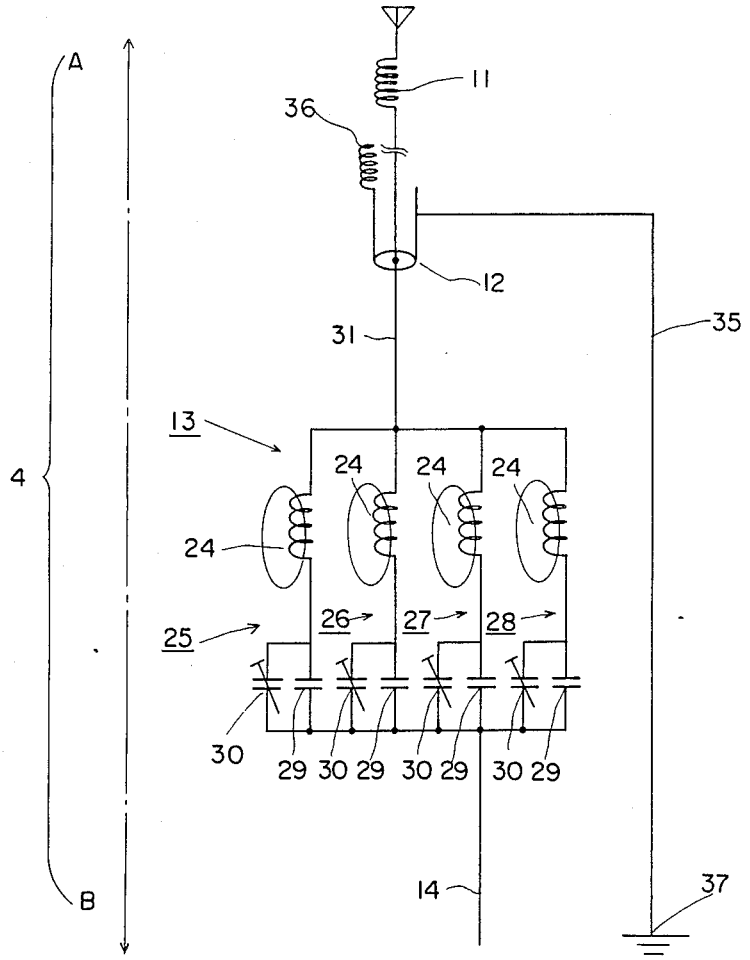
FIG. 5 shows a circuit diagram of the resonator circuit.

The intermediate part 6 can be bent and held in the bending position to permit the antenna to take a vertical posture regardless of what posture an associated wireless may take. Specifically, when the intermediate part 6 is bent at an angle appropriate for keeping the antenna vertically erected, the spiral metal strip g invades deeper into the spaces between adjacent turns of the coil spring at the bending portion, thereby preventing the intermediate part from resiliently spring back to the initial straight position. Thus, the antenna remains in the bending position until it has been straightened with hands. The part of the central antenna conductor 4 in the lower antenna section 2 comprises a screw 10, a small-diameter coil section 11, a large-diameter coil section which is composed of a coaxial cable winding 12, a coil-and-capacitor resonator arrangement 13, a central contact 14 and a connector 15 in the order named. The small-diameter coil section 11 and the coaxial cable winding 12 are wound on a bobbin 16. The screw 10 is integrally connected to the top end of the bobbin 16, and is screwed into an insulator 17 and a metal piece 18 of the intermediate part 6. The screw 10 and the small-diameter coil 11 are connected in an aperture 19 of the bobbin 16. As for the resonator arrangement 13, it has four insulator base plates 20, 21, 22 and 23 crosswise-connected (the base plate 23 being invisible in FIG. 2 because it is positioned behind the sheet). Each base plate has a series connection of coil 24 and capacitor means (non-variable capacitor 29 and variable capacitor 30 connected in parallel). Thus, there are four resonator circuits 25, 26. 27 and 28. The coaxial cable has a central conductor 31 connected to these resonator circuits. Referring to FIG. 5, the resonator arrangement 13 is composed of a parallel-connection of the four resonator circuits 25, 26, 27 and 28. The central conductor 31 of the coaxial cable 12 is connected to one end each of these resonator circuits, and the other end of each of these resonator circuits is connected to the central contact 14. Each resonator circuit is composed of a series connection of coil 24 and parallel-connected non-variable capacitor 29 and variable capacitor 30. These capacitors electrically devide or decouple the central antenna conductor into the upper section A and the lower section B. Thus, the upper and lower sections are not connected directly to each other in the form of line.

An insulator 32 encircles the central contact 14, and a metal ring 33 encloses the insulator 32. Another metal piece 34 is threadedly fitted around the metal ring 33. One end 36 of the outer sheath 35 of the coaxial cable 12 is open-ended whereas the other end 37 of the outer sheath 35 is connected to the metal ring 33, and finally to the cylindrical sleeve 3 via the metal piece 34. The outermost sleeve 38 is fixed to the fitting 39 of an associated wireless.

When in use, the non-stationary antenna is fixed to a portable wireless or a car-borne wireless. The electromagnetic wave can be radiated from or received by the central antenna conductor 4 of the antenna. Assume that reflection of the radiated electromagnetic wave from the earth's surface is changed with surrounding variable factors, such as the configuration of the ground, the electrically conductive condition of the ground, buildings of different heights, the strength of the magnetic field of the earth etc. These surrounding variables will affect the upper antenna section A of the antenna, but the resonator circuit 13 is guaranteed free of the effect caused in the upper antenna section A, which is put in the floating condition in the air. Thus, the present resonant frequency, characteristic impedance, radiation angle, voltage standing wave ratio, gain and other characteristics will remain unchanged. Thus, the characteristics of the antenna are independent from the surrounding variable factors. This is partly attributable to the fact that the outer sheath 35 of the coaxial cable 12, which is not terminated at one end 36 and is connected to the cylindrical metal sleeve 3 at the other end 37, provides an impedance high enough to prevent the flow of electric current, thus causing no radiation. Also, the characteristics of the antenna remain unchanged even if the antenna is held in one's hand, or is brought in contact with a metal object or if the antenna is used in the rain or snow.

Figure 4:
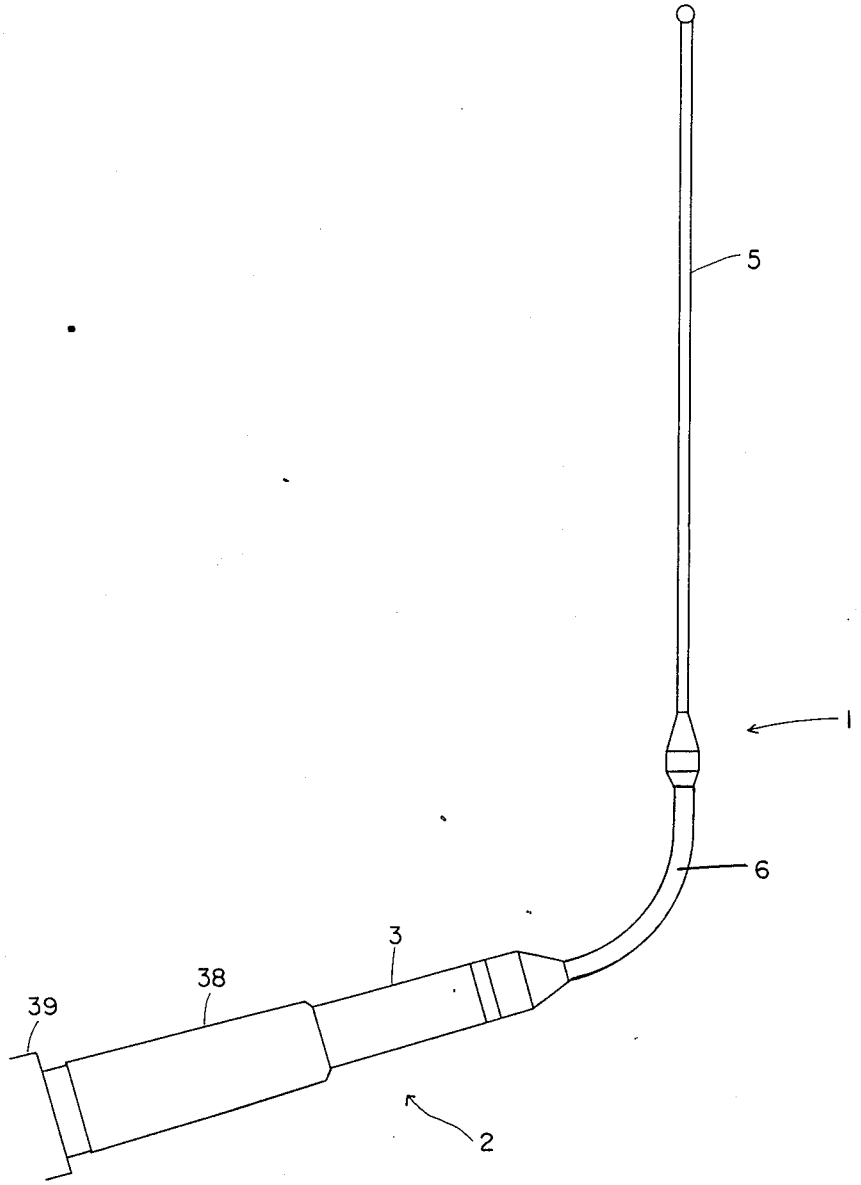
FIG. 4 shows the non-stationary antenna which is bent when in use.

Assume that one carries a wireless on one's back, and that he lies on the ground. Then, he bends the intermediate part 6 of the antenna as seen from FIG. 4 so that the antenna may take a vertical posture while he is lying on the ground.

Also, it should be noted that the structural arrangement of the antenna makes it easy to adjust the resonance frequency and other characteristics of the antenna exactly to what is desired in the course of manufacture. This particular embodiment has four resonant circuits 25, 26, 27 and 28. For instance, a desired voltage standing wave ratio can be set by adjusting the variable capacitors 30 of three resonator circuits arbitrarily selected from the four resonator circuits 25, 26, 27 and 28 and then a desired resonance frequency can be set by adjusting the variable capacitor of the remaining resonator circuit.

The resonator circuits are parallel-connected and each resonator circuit includes a parallel connection of non-variable and variable capacitors. Thus, the resonator section has a relatively large number of variable capacitors, thereby making it easy to meet a particular request. Each variable capacitor has a least influence on adjustment of a particular antenna characteristic. This permits the adjustment for instance, of the resonance frequency as closest as possible to the desired one by trimming selected variable capacitors. If one of the four resonator circuits has a large non-variable capacitor 29 compared with the non-variable capacitors of the other resonator circuits, a required final fine-adjustment can be easily performed by adjusting the large non-variable capacitor 29.

What is claimed is:

1. A non-stationary antenna, comprising:

a central antenna conductor having an upper antenna section and a lower antenna section, a part of said lower antenna section including a coaxial cable having an inner conductor and an outer sheath, said outer sheath having first and second ends;

a cylindrical metal sleeve encircling said lower antenna section;

said first end of said outer sheath of said coaxial cable not being electrically connected to any other elements and said second end of said outer sheath of said coaxial cable being connected to said cylindrical metal sleeve;

a resonator circuit arrangement placed in said lower antenna section, said resonator circuit arrangement including a plurality of parallel connected resonator circuits, each resonator circuit comprising a coil and a capacitor bank connected in series, each capacitor bank including a variable capacitor and a non-variable capacitor connected in parallel, said resonator circuit arrangement being an only electrical connection between said upper antenna section and said lower antenna section.

2. Non-stationary antenna according to claim 1 wherein the non-variable capacitor of one of said resonators has a capacitance larger than the non-variable capacitor of each of the remaining resonators.

3. Non-stationary antenna according to claim 1 wherein an intermediate part of said upper antenna section includes a metal spring coil and a metal spiral strip fitted in the turn spaces of said metal spring coil.

* * * * *